United States Patent [19]

Bernard

[11] 4,252,575

[45] Feb. 24, 1981

[54] PRODUCING HYDROUS OXIDE OF CONTROLLED THICKNESS ON ALUMINUM CAPACITOR FOIL

[75] Inventor: Walter J. Bernard, Williamstown, Mass.

[73] Assignee: Sprague Electric Company, North Adams, Mass.

[21] Appl. No.: 65,302

[22] Filed: Aug. 9, 1979

[51] Int. Cl.[3] ..... C23F 7/06

[52] U.S. Cl. ..... 148/6.27; 204/33; 204/38 A

[58] Field of Search ..... 148/6.27; 204/33, 38 A

[56] References Cited

U.S. PATENT DOCUMENTS

| | | | |
|---|---|---|---|
| 2,018,694 | 10/1935 | Wetherbee | 148/6.27 |
| 2,079,516 | 5/1937 | Lilienfeld | 427/80 |
| 2,404,824 | 7/1946 | Booe | 427/80 |
| 2,868,702 | 1/1959 | Brennan | 204/28 |
| 3,600,245 | 8/1971 | Gates | 156/665 |

FOREIGN PATENT DOCUMENTS 518733 3/1940 United Kingdom .

OTHER PUBLICATIONS

D. Altenpohl, Aluminum 33 #2, pp. 78–91 (Feb. 1957), Eng. transl.

W. J. Bernard and J.J. Randall, J. Electrochem Soc., 108#9, pp. 822–825, (Sep. 1961).

*Primary Examiner*—Ralph S. Kendall

*Attorney, Agent, or Firm*—Connolly and Hutz

[57] ABSTRACT

The thickness of a hydrous oxide layer on aluminum capacitor foil is controlled by producing the oxide in a hot, dilute borate solution with a pH of about 6, prior to anodization of the foil.

10 Claims, 2 Drawing Figures

PRODUCING HYDROUS OXIDE OF CONTROLLED THICKNESS ON ALUMINUM CAPACITOR FOIL

BACKGROUND OF THE INVENTION

This invention relates to controlling the thickness of a hydrous oxide film on aluminum capacitor foil by producing the film in a dilute borate solution prior to the anodization of the foil.

It is known to produce hydrous oxide films on aluminum electrolytic capacitor foil by contacting the foil with hot or boiling water. The thickness of the film depends mainly on the contacting time. Because the initial rate of reaction is rapid, it has been difficult to control film thickness when thin films are required. One way of controlling such thickness has been to decrease reaction time to less than one minute. Another method of controlling thickness has been to carry the reaction out below 100° C., e.g., 85° C.

The prior art processes have been satisfactory for most foils, but have not always been as reliable as desired when etched foil for low-voltage capacitors is involved. For example, it is commonly known that hydrous oxide growth does not occur instantaneously upon immersion in hot water but that a brief induction period occurs before reaction starts. This period can vary by a few seconds, depending upon foil condition, and therefore the actual reaction time—and then the film thickness—can be seriously affected when the total immersion time is below one minute.

It is also known that small amounts of impurities in hard water suppress the growth of the hydrous oxide layer. Such suppression takes place when silicates, sulfates, carbonates, citrates, borates, oxalates, phosphates, and chromates are present. When small amounts of these materials were used, the layers were of normal thickness but unstable; when larger amounts were used, the layers were thin and gave little protection against water or corrosive materials.

SUMMARY OF THE INVENTION

This invention features the use of a dilute borate solution at a pH of about 6 to produce a film of stable hydrous oxide of controlled thickness at long enough reaction times so that the above step may be easily integrated with prevailing manufacturing steps. The invention may be used on foil for any voltage range but is particularly useful for low voltage foil to deposit a thin layer of hydrate so as not to plug the fine etch structure.

Foil so treated may be further treated before anodization to increase capacitance gain during anodization. Thus, the foil may be subsequently contacted with a hot partly neutralized silicate or a phosphate solution prior to anodization.

DESCRIPTION OF THE PREFERRED EMBODIMENTS

Figure 1:
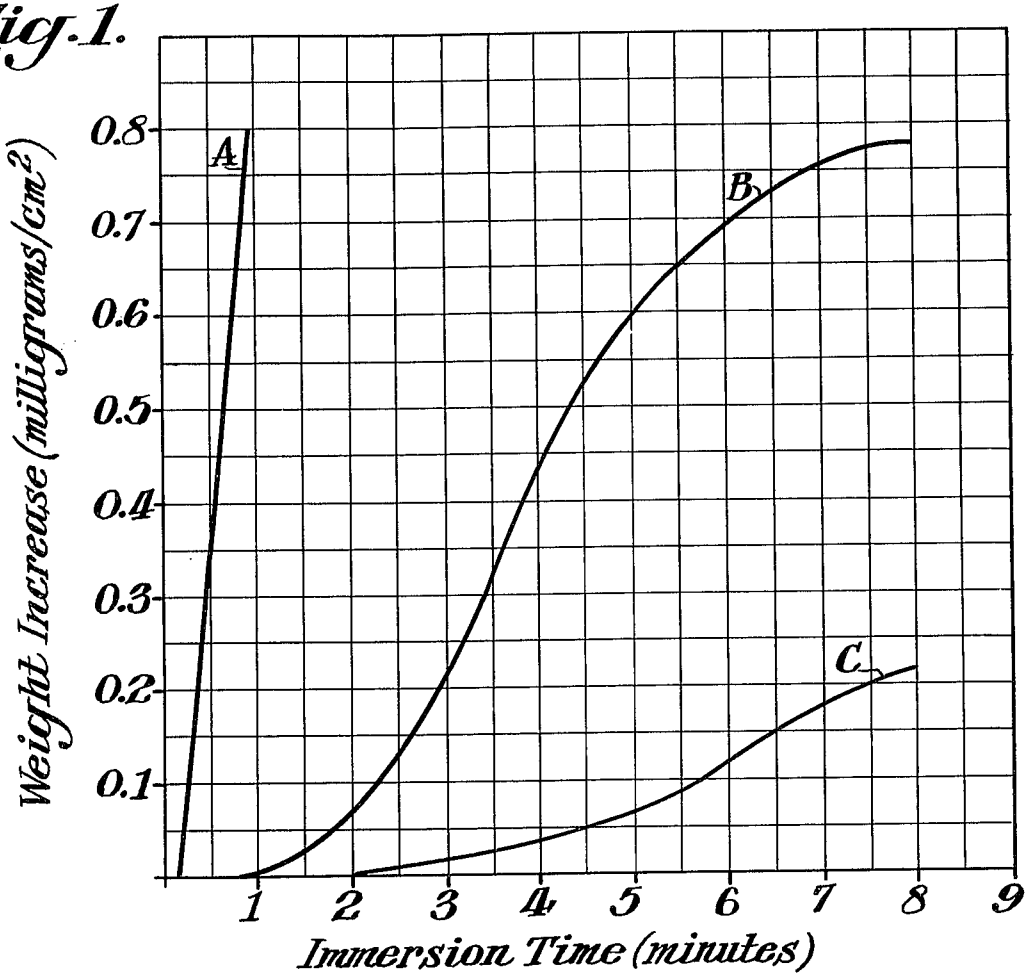
FIG. 1 is a graph showing growth of hydrous oxide layer as weight gain (mg/cm$^2$) versus immersion time (min) for boiling water (A), a boiling aqueous solution containing 3 g/l boric acid (B), and a boiling aqueous solution containing 6 g/l boric acid (C); both borate solutions being at pH 6.

FIG. 1 compares the growth rate of hydrous oxide films on aluminum in water, and in two aqueous solutions of boric acid adjusted to pH 6 with borax. As curve A shows, the weight gain in boiling water went from zero milligrams to 0.8 mg in one minutes. Such a rapid rate is difficult to control for reproducible results. Curve B shows that the time to reach such a weight gain in a boiling aqueous solution at pH 6 containing 3 g/l boric acid has been lengthened to 8 min, a much more controllable rate. Curve C shows the effect of increasing the boric acid concentration of the solution to 6 g/l, also at pH 6.0.

Figure 2:
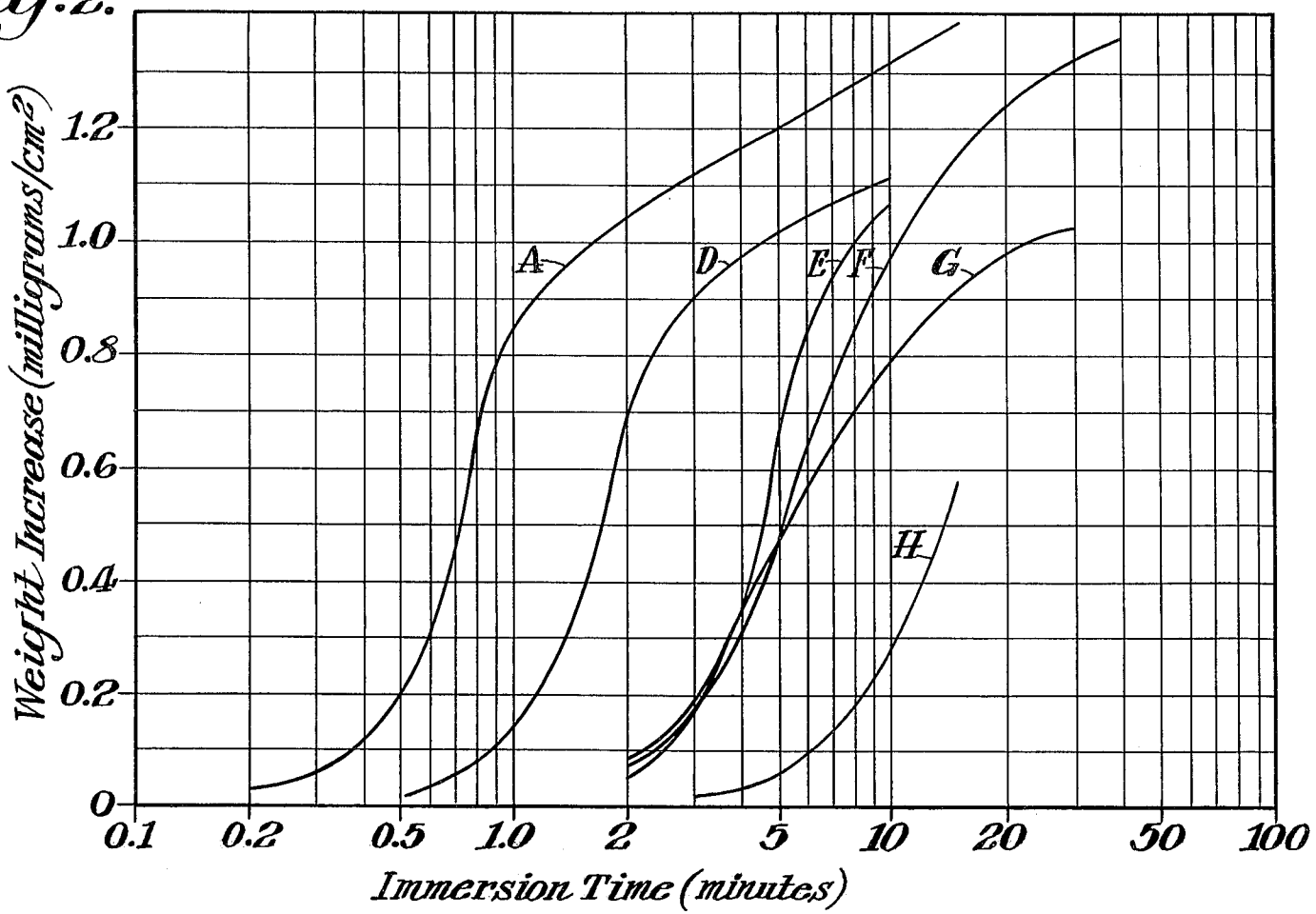
FIG. 2 shows growth of hydrous oxide layer as weight increase (mg/cm$^2$) versus immersion time (min) at 100° C. for water (A), an aqueous solution containing 1.0 g/l boric acid at pH 6.2 (D), aqueous solutions containing 3.25 g/l boric acid at pH 5.7 (E), at pH 6.0 (F), at pH 6.5 (G), and an aqueous solution containing 6.0 g/l boric acid at pH 6.5 (H).

While the general trend is that when the concentration increases, the time needed to form a given weight of hydrous oxide also increases; pH was found to have a competing effect as seen in FIG. 2. Curve F is essentially curve B of FIG. 1 (3.25 vs 3.0 g/l boric acid), and curve H is essentially curve C of FIG. 1 (pH 6.5 vs pH 6.0). A decrease of 0.3 pH unit (curve E) has the effect of displacing the reaction toward that of lower concentration, while an increase of 0.5 pH unit has the effect of displacing it toward higher concentrations.

It was unexpected that small changes in pH would have as great an effect as they did. Thus, both pH and concentration need to be controlled for reproducible results. It was found by experimentation that a pH around 6 was the most suitable for controlled growth of hydrous oxide films on aluminum using aqueous solutions of boric acid. However, a pH of 5.5 to 7.0 gives acceptable results within the desired concentration ranges. If higher concentrations are desired, then the pH can be lowered to give acceptable results. Likewise, lower concentrations may be used at higher pHs.

For the particular manufacturing scheme being used, a contacting time of 3 minutes was chosen as preferable for ease of integration of this boric acid treatment step into the sequence. This preferred time corresponds to 3.25 g/l boric acid adjusted to pH 6 by 6.0 mg/l borax (curve F of FIG. 2).

The foil may subsequently be treated with a dilute aqueous phosphate of pH 5 to 7 solution or a sodium silicate solution partly neutralized to pH 7 to 12, preferably 10 to 11, by tartrate as described in copending patent application Ser. No. 35,145 filed May 2, 1979, to further increase capacitance upon anodization.

In the following examples, the treatment was carried out in a boiling borate solution to allow direct comparison to the known boiling water treatment. In actual production line use, the treatment may be carried out at just below the boiling point, e.g., about 95° C., to provide a better temperature control and to reduce heating costs.

Also in the following examples, the weight increase in mg/cm$^2$ is based on apparent, not true, area because of the different etching of the high-and low-voltage foil. The experiments were carried out to give the same apparent weight increase for each set of foil samples. The percent capacitance increase is based on the sample compared with untreated etched foil.

EXAMPLE 1

In order to compare the behavior of hydrous oxide films prepared by a conventional boiling water treatment and by the borate treatment of the present invention, aluminum foil etched for low-voltage use was contacted with boiling water or with a boiling solution of 6.0 g/l boric acid adjusted to pH 6 with borax. After formation of the hydrous oxide films, the foils were contacted with a boiling sodium silicate solution for 7.5 min. The foils were anodized to 60 V in a 0.1% aqueous ammonium dihydrogen phosphate solution.

TABLE 1

| Medium | pH | Time to form film | Weight increase mg/cm$^2$ | Capacitance $\mu$F/cm$^2$ | % Cap. increase |
|---|---|---|---|---|---|
| Water | — | 0.5 min | 0.19 | 3.92 | 14 |
| Boric acid | 6.0 | 8.0 min | 0.22 | 3.97 | 15 |

Similar results were obtained when the silicate solution was replaced by a phosphate one at pH 5 to 7.

EXAMPLE 2

In order to demonstrate the behavior of thicker oxide films, aluminum foil etched for high-voltage use was contacted with boiling water or with a 3.25 g/l boric acid solution at pH 5.7. After formation of the hydrous oxide films, the foils were anodized in dilute phosphate solution to 150 V.

TABLE 2

| Medium | pH | Time to form film | Weight increase, mg/cm$^2$ | Capacitance $\mu$F/cm$^2$ | % Cap. increase |
|---|---|---|---|---|---|
| Water | — | 1.0 min | 0.19 | 0.54 | 33 |
| Boric acid | 5.7 | 7.0 min | 0.18 | 0.62 | 51 |

EXAMPLE 3

To show the effect of low-voltage oxide on a coarse etch structure, high-voltage aluminum foil was contacted with boiling water or with 3.25 g/l boric acid solution adjusted to pH 6.0 with borax. The foils were anodized to 60 V in dilute phosphate solution.

TABLE 3

| Medium | pH | Time to form film | Weight increase, mg/cm$^2$ | Capacitance $\mu$F/cm$^2$ | % Cap. increase |
|---|---|---|---|---|---|
| Water | — | 1.0 min | 0.19 | 1.33 | 24 |
| Boric acid | 6.0 | 9.0 min | 0.19 | 1.41 | 32 |

EXAMPLE 4

In this example, the effect of boric acid solution at a higher pH is demonstrated. After formation of the hydrous oxide films, the foils were anodized to 150 V.

TABLE 4

| Medium | pH | Time to form film | Weight increase, mg/cm$^2$ | Capacitance $\mu$F/cm$^2$ | % Cap. increase |
|---|---|---|---|---|---|
| Water | — | 1.0 | 0.19 | 0.54 | 33 |
| Boric acid | 6.5 | 7.5 | 0.19 | 0.58 | 43 |

In every case, the boric acid treatment not only lengthened the time to form the hydrous oxide film so that this formation can be better controlled, but also it resulted in a higher capacitance for the same amount of hydrous oxide. Thus, either capacitance can be increased for a given amount of anodization, or anodization savings can be realized for a given capacitance level.

What is claimed is:

1. A process for controlling the thickness of a hydrous oxide layer formed on aluminum electrolytic capacitor foil comprising forming said hydrous layer of controlled thickness in a hot dilute aqueous borate solution consisting essentially of 1 to 6 g/l boric acid and sufficient borax to provide a pH of 5.5 to 7.0 for 1 to 10 minutes to provide a weight increase of up to 0.8 mg/cm$^2$.

2. A process according to claim 1 wherein said borate solution contains 2 to 6 g/l of boric acid and sufficient borax to provide a pH of 5.7 to 6.5.

3. A process according to claim 2 wherein said pH is 6 and the temperature of said solution is between 95° C. and its boiling point.

4. A process according to claim 3 wherein the residence time is 3 minutes, said boric acid concentration is 3.5 g/l, and said borax concentration is 6.0 mg/l to provide said pH of 6.

5. A process according to claim 1 wherein said foil is etched foil.

6. A process according to claim 1 wherein said foil with said hydrous oxide thereon is immersed in an aqueous solution between 95° C. and its boiling point of a phosphate or a partly neutralized silicate to modify said hydrous oxide layer and increase capacitance.

7. A process according to claim 6 wherein said aqueous phosphate solution has a pH of 5 to 7 and said silicate solution has been partially neutralized by a tartrate to a pH of 7 to 12.

8. A process according to claim 7 wherein said silicate solution has a pH of 10 to 11.

9. A process according to claim 7 wherein the residence time in said aqueous solution is 2 to 12 minutes.

10. A process according to claim 9 wherein said residence time is 6 to 8 minutes.

* * * * *